United States Patent [19]

van Weezenbeek

[11] Patent Number: 4,604,000

[45] Date of Patent: Aug. 5, 1986

[54] METHOD FOR REMOVING SLUDGE OR MUD FROM THE BOTTOM OF A WATER AREA

[76] Inventor: Reijer N. van Weezenbeek, Torenweg 14, 3535 NS Rockanje, Netherlands

[21] Appl. No.: 590,463

[22] Filed: Mar. 16, 1984

[30] Foreign Application Priority Data

Mar. 18, 1983 [NL] Netherlands ..... 8300990

[51] Int. Cl.[4] ..... E02F 3/88

[52] U.S. Cl. ..... 405/52; 37/78

[58] Field of Search ..... 405/203, 52, 74; 37/78, 37/63, 67

[56] References Cited

U.S. PATENT DOCUMENTS

| | | | |
|---|---|---|---|
| 260,200 | 6/1882 | Huffer | 37/78 |
| 301,682 | 7/1884 | Coiseau | 37/78 |
| 423,716 | 3/1890 | Baker | 37/78 |
| 445,862 | 2/1891 | Roessler | 37/78 |
| 510,713 | 12/1893 | Scott | 37/78 |
| 585,116 | 6/1987 | Nichols | 37/78 |
| 727,059 | 5/1903 | Balch | 37/78 X |
| 1,268,387 | 6/1918 | Reed | 37/78 |
| 1,698,515 | 1/1929 | Stewart | 37/78 |
| 3,412,862 | 11/1968 | Chaplin . | |
| 3,470,633 | 10/1969 | Soehnlen | 405/203 X |
| 3,885,331 | 5/1975 | Mathieu . | |

FOREIGN PATENT DOCUMENTS

| | | | |
|---|---|---|---|
| 1634017 | 1/1971 | Fed. Rep. of Germany . | |
| 446073 | 3/1949 | Italy | 37/78 |
| 595291 | 12/1947 | United Kingdom . | |

*Primary Examiner*—Dennis L. Taylor

*Attorney, Agent, or Firm*—Stevens, Davis, Miller & Mosher

[57] ABSTRACT

The invention relates to a method and apparatus for the removal of mud from the bottom of a water area by injecting water into said mud which injection according to the invention is done in such a way that the mud layer is changed into a mud layer having a thick liquefied condition which mud layer then by its higher specific mass by itself flows towards a lower level where it is taken away by means of a pump or by means of a natural flow such as the flow of a river.

7 Claims, 6 Drawing Figures

METHOD FOR REMOVING SLUDGE OR MUD FROM THE BOTTOM OF A WATER AREA

The invention relates to a method for removing mud deposited upon the bottom of a water area in which the flow, if occuring, at least temporarily is slight or absent, such that solid particles present in the water can be deposited in the form of a layer which in times of flow is substantially maintained, which mud layer is removed by desintegration making use of water jets.

In particular water areas are meant, such as a habour, a basin, a lake, into which by means of a water flow debouching into it, flowing alongside it or through it, solid particles are supplied, which obtain the possibility to settle down onto the bottom into the more quiet portions of the said water area and in due course form a thick layer of sludge or mud which is not disturbed anymore during temporarily occurring flow movements. Such a water area also in an area subjected to tide flows within which during the entering flood-tide flow particles are fed in, which particles during the returning ebb-tide flow no longer all are fed back so that a deposit takes place.

The above-mentioned known method is known in different forms. Thus from German published patent application 16 34 017 it is known to work with a tube having jet nozzles which tube can be lowered upon the bottom and has been provided with a sliding shoe as well as with a scraper blade, which scraper blade serves to cut a chip of the mud layer or sludge layer which chip upon the blade is finally divided with the aid of the water jets directed upon the blade. The aim is to obtain such a fine division that the mud returns into its original condition, which means the condition in which the mud particles within the water represent a very light density. One expects from said known method that the mud finally divided in this manner will disappear by leaving it to the flow present or occurring at said location. This known method requires a large quantity of water whereas the effect is doubtful. According to said known method it of course is possible to remove mud deposits in flowing water. This publication also refers to habour basins. The flow occurring therein may be the inwardly and outwardly moving flow resulting from the tide.

From the British patent specification 595,291 it is known for the removal of mud deposits to lower jet nozzles and to move them through the mud layer from which jet nozzles water jets and compressed air flow out. The air bubbles have to feed the loosened mud particles towards the surface where they also are left over to the normal flow. This publication as well by the way refers to a habour area but for this holds true as well that the method known from said British specification can function only if a flow occurs in said habour area such as a tide flow.

From U.S. Pat. No. 3,412,862 it is known to treat the bottom with water jets which have to wirl the mud as well as the sand layer below it and in which the sand particles are separated from the mud particles by means of a baffle, whilst the loosened mud particles are immediately sucked away. Said known method requires a complicated device, which is expensive.

The problem of mud deposits in water areas in which there is no or hardly a flow respectively, such that deposits can take place, forms a very old problem. In many habours one has to fight it continuously to maintain sufficient floating depth.

In practice the methods according to the above-mentioned publications are not applied but use is made of bucket dredgers or hopper suction dredgers. Vessels of this kind, in particular hopper dredgers, are expensive because they in fact have been designed for dredging sand, gravel or clay. There exist vessels specially designed for said purpose, which means vessels for sucking mud and storing the mud in the hold. This mud has to be discharged somewhere else, which, in particular due to the high water content of the mud is an unefficient and therewith costly way of proceeding.

Mostly one sees that bucket dredgers are applied and some times a bucket crane. In both cases the production capacity is low and accordingly the costs are high as well.

The need for a cheap method accordingly has to be very old.

The purpose of the invention is to provide a method by means of which in a very simple and accordingly cheap manner it is possible to entirely or mainly remove mud deposits.

According to the invention this purpose is achieved in that the mud layer by means of jet nozzles inserted directly into the mud layer and by the water leaving said nozzles is transferred into a thick liquefied condition such that the mud substance liquefied in this way is capable of flowing under the influence of its difference in specific mass with respect to the water towards a place at a level lower than the upper limit of the mud layer and preferably at the level of the original bottom or lower at which place a mud carrying flow exists or is generated respectively.

Accordingly according to the invention it is avoided to desintegrate the mud layer with the aid of such an overdose of water that the mud particles within the water again substantially show the original low density and accordingly can be discharged easily if there is a flow, on the contrary the mud mass by the water injection only is transferred into a thick liquefied pulp which still recognizable a as mud layer remains upon the bottom and by its still present difference in specific mass now by nature will have the tendency to start movement, which means to flow to a place or places which are at lower level. Such a lower located place can be present by nature, e.g. at a habour basin joining a river. The mud layer liquefied or made more flowable by the water injection then at the mouth will flow over the edge and come into the flowing river. Said river then takes care for finer division and discharge. An ebb-tide flow can be used for the same purpose.

It is feasible as well to make a recess or well in the bottom and to place in it a suction pressure pump. If one then starts with injection away from the edge of the well the thick liquefied or made more flowable mud will flow towards the pump and be removed in this way.

Whereas according to all known methods, which operate with the injection of water or a combintion of water and air, one aims at a whirling and vertebration as intensive as possible of the mud particles, the invention is based on the principle that the mud layer maintains a mud layer, which is made liquid or liquefied due to which the mud layer by itself can start to flow towards a place where there exists or is generated respectively a discharging flow. If so desired said flow movement can be supported by generating an artifical flow in the area to be treated.

If one has to deal with e.g. a habour basin joining a flowing water such as a river, then according to the invention injection can start at the location of the mouth of the habour basin with the river and can progress according to a path which is directed away from the mouth and each subsequent path, provided place is available, starts as well at the mouth adjacent to the already treated path. By starting with the injection of water into the mud layer at the locaton of the mouth and changing it accordingly into a flow mass said mass will flow away in a laminair way and through the mouth enter the river where it is taken away by the flowing river water. As the liquefied mud layer flows in the direction of the river one can progress with liquefying, which means that one can move away from the mouth, so that again and again a new mass is formed which can flow away in the direction of the mouth. In this way a channel is formed.

If in this respect one has to deal with an area having one or more basins extending laterally next to the mouth or inlet, then said basins can be treated according to adjacent parts joining the path or paths made away from the mouth. This means accordingly that first the mud layer is removed over a width corresponding to the width of the mouth. Thereafter one continues in a direction transversely to the removed path or channel by pathwise injecting water and then the mud from the lateral basins will flow towards the already cleaned path and from there through the cleaned path flow towards the river.

If the distance towards the mouth becomes too large so that the risk exists that the liquefied mud mass comes to a stand still, then the method can be repeated in a mud layer which in the meantime has been considerably reduced, however, one also can take care that at the location of the cleaned path, which means in the area to be treated an artificial flow is generated so that the liquefied mass is supported in its movements towards the discharge location. This can be done in many ways e.g. by making use of the thrust of the propeller of a vessel which is anchored, by feeding in fresh water as upper flow so that an underflow is generated directed towards the mouth and one can do this by applying a method and apparatus as described in another non-prepublished patent application.

Furthermore the movement of the liquefied mass can be supported in a mechanical way which means with a pushing blade which is moved in a direction towards the discharge. This accordingly can be done with a vessel carrying a bull-dozer blade. At a habour basin bordering a flowing water, it however also can be important that by means of the injection one first makes a flow channel directed towards the mouth and that thereafter at a place located at a distance from the mouth the mud layer is stripwise removed in the direction towards the mouth.

With some habour basins it can be desirable, e.g. due to the condition of the river, not to transfer the liquefied mud layer towards the river, but to discharge in a different manner.

In water areas with quiet water not bordered by a flowing water, the principle underlying the invention can be applied, in the same way as with the just mentioned habour areas which may not discharge into the river, by making a recess or well in the bottom of the area to be treated and to place in it the suction opening of a suction pressure pump, after which the injection of the water making the mud layer thick liquefied and accordingly flowable is performed in a manner which starts at the well and is directed away from it, e.g. according to paths. The thick liquefied mass then flows into the direction of the well is sucked away there and through the pressure conduit brought towards a storage yard or towards a hopper or other transportation means or dumped in the river at another location where the flow is sufficient to avoid difficulties from the inserted mud. With storage in a hopper or on yards respectively one then moreover has the further advantage that the water concentration is smaller than in case one would operate with a normal hopper suction dredge or mud dredge.

If the mud pumped away in this manner has to be returned into the river it can be strongly diluted by adding additional water preferably soft surface water. If this is done in a brackish water area then no desity flow of the discharged mud in the direction of the bottom will be formed. On the contrary the mud will be taken up in the upper water layers and be discharged towards the sea. By diluting with soft water the specific mass of the mud mixture can be made lower than the specific mass of salt water moving over the bottom. The chance of renewed sedimentation then is minimal.

Placing a pump in a recess or well moreover has the advantage that the liquefied mud may have a much larger density then mud sucked up by means of a hopper dredger. The pump can be placed lower than the suction head of a hopper dredger and accordingly is less disturbed by gasses released from the mud. In a hopper suction dredger the released gasses disturb the operation of the suction pressure pump. With the method according to the invention, the gasses, however, already are removed as a result of the water injection. The removal of gas moreover can increase the specific mass which promotes the outflow.

If one operates in this manner the pump has to be protected by means of a basket against objects which cannot be handled. Of course in making use of a pump in a recess or well the above described auxiliary flows and auxiliary means can be used as well if the distance of the place of water injection to the well becomes too large.

The invention also relates to an apparatus for performing the method according to the invention which apparatus in a manner comparable with the device known from the German published application 16 34 017 can comprise a vessel having a tube which can be lowered upon the bottom and extends transversely to the direction of movement of th vessel and which has been provided with injection nozzles and a pressure water supply which apparatus according to the invention then is characterized in that the injection nozzles are exclusively directed downwardly and the water jets emerging therefrom can be directed unhampered upon the layer to be treated.

The invention now will be further elucidated with reference to the drawings.

Figure 1:
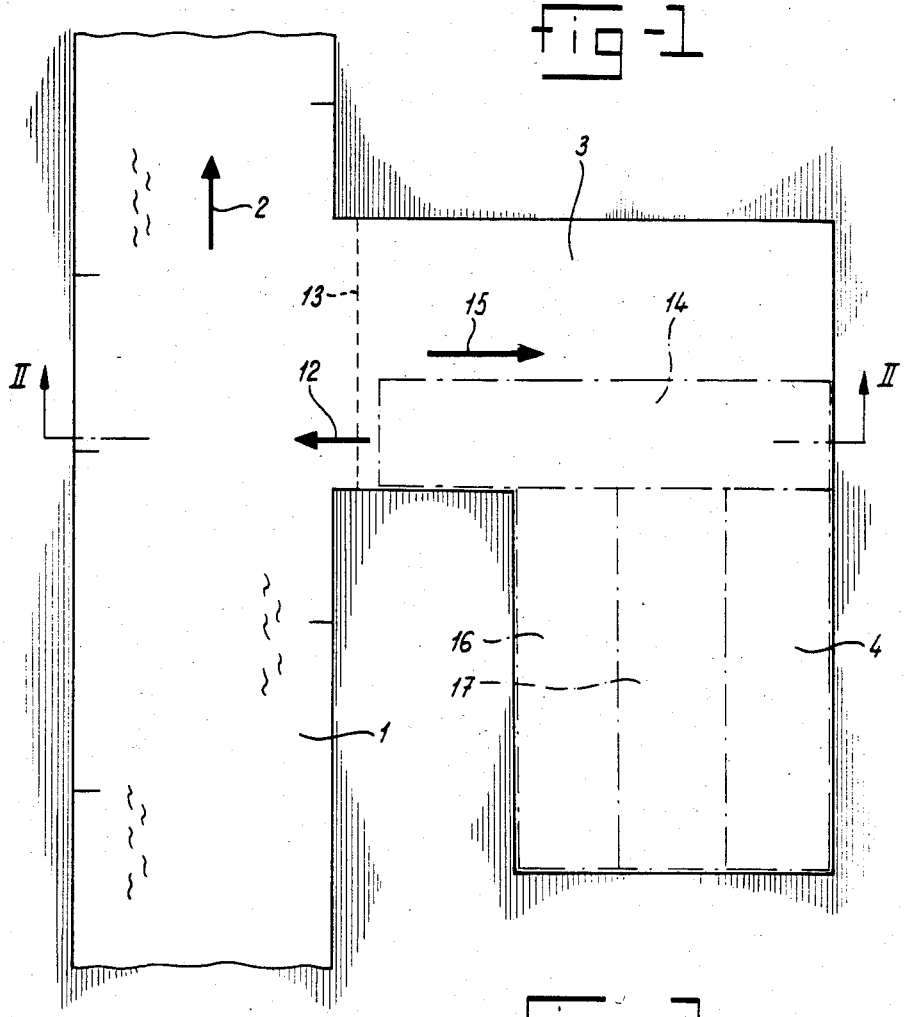
FIG. 1 shows schematically in top view a habour basin to be treated.

FIG. 1 shows a river 1 which flows in the direction of the arrow 2. Next to the river is a habour basin 3 having a side portion 4.

Figure 2:
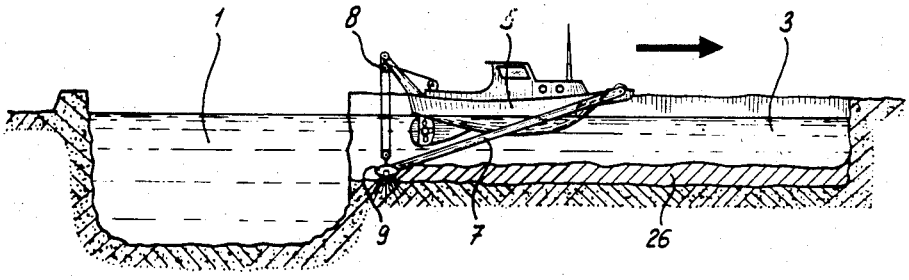
FIG. 2 is a cross section of FIG. 1 along line II—II.
Figure 3:
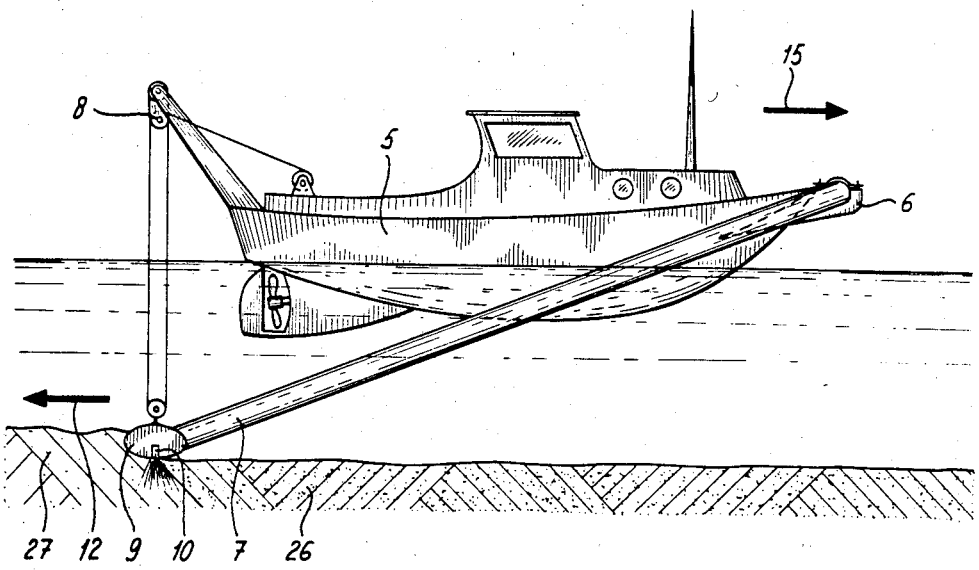
FIG. 3 shows a side view of an apparatus as shown in FIG. 2 but at a larger scale.
Figure 4:
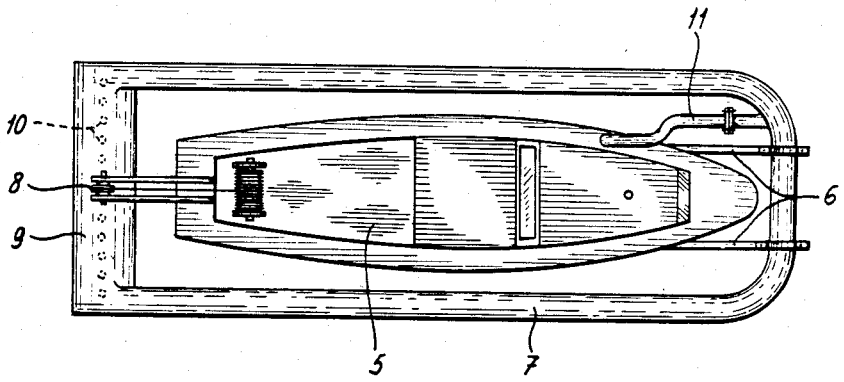
FIG. 4 is a top view of said apparatus of FIG. 3.

FIG. 2 shows the river in cross section as well as the habour portion 3 with in it the apparatus 5 shown at larger scale in FIGS. 3 and 4.

In the habour 3, 4 there is a mud layer 26.

The apparatus 5 shown in FIGS. 3 and 4 comprises a vessel having at the front side a pair of forwardly extending arms 6 carrying a tube 7 which may pivot in the outer ends of the arms 6 and which can be lowered by means of a tackle or the like 8, e.g. in the position shown in FIG. 3. Said tube at the rear end has a transverse tube 9 with a row of injection nozzles 10. By means of a not shown pump sucking in water through an inlet lying adjacent to the vessel through a connection 11 water is supplied to the tube by pressing it into the conduit 7 which water through the tube 9 and the nozzles 10 can flow out. If said tube 9 with nozzles 10 is lowered upon the mud layer 26 and water is injected in the mud layer then said layer due to the supply of water expands towards a shape as e.g. shown at 27 and changes it into a thick liquefied flowing mass having the tendensity to flow in the direction of the arrow 12.

In FIG. 1 the sill between habour basin 3 and river 1 has been indicated at 13. If one now starts by placing the apparatus 5 with tube 9 at line 13 and one moves said apparatus in the direction of arrow 15 then in FIGS. 1 and 3 at the left side of tube 9 a flowable mass is formed which in the direction of the arrow 12 flows towards the river and there is taken away by the flow. If according to arrow 15 a path is treated having a width corresponding to the length of the tube 9 accordingly according to the width of the path 14, then one can in this manner treat the adjacent path starting at the mouth 13. If one has done this then one can treat parts 4 in the side basin such as 16 and 17.

Figure 5:
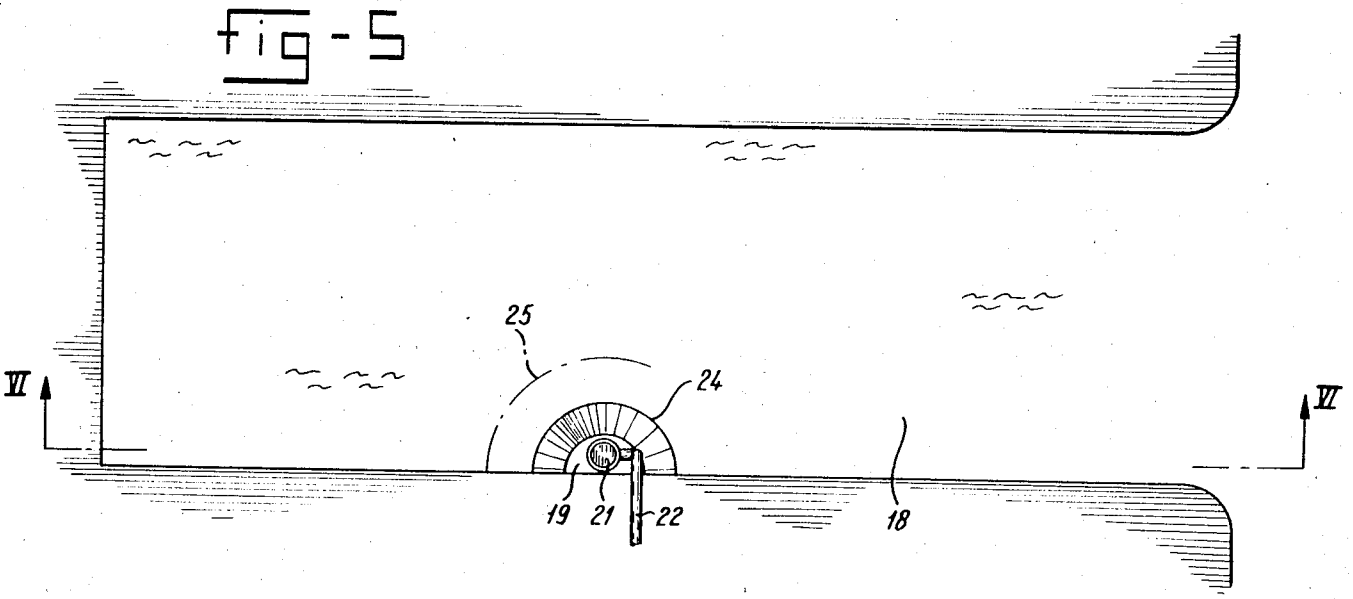
FIG. 5 shows in top view another embodiment of the method according to the invention and FIG. 6 shows a cross section along line VI—VI of FIG. 5.
Figure 6:
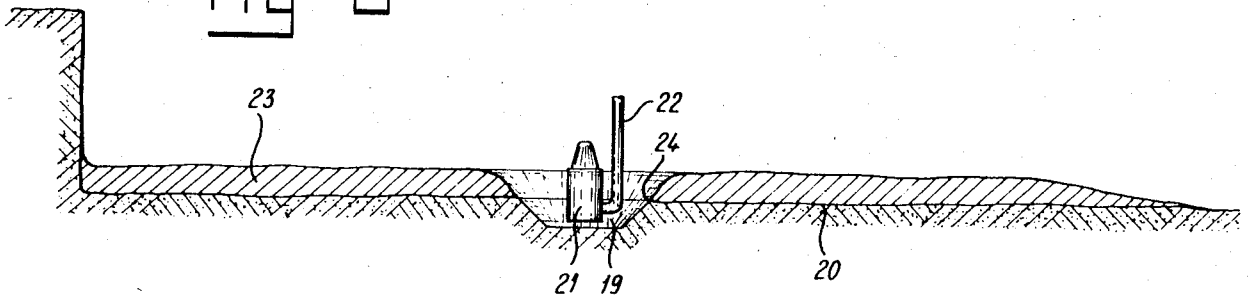

FIGS. 5 and 6 also show a habour basin bordering a river but instead of such a habour basin also a lake or the like water area can be chosen having no connection with flowing water. At 19 in the habour basin 18 shown in FIGS. 5 and 6 a well has been made the bottom of which being lower than the bottom 20 of the habour. In said well a pump 21 has been placed with pressure conduit 22 leading outside the habour area.

If now water is injected into the mud layer 23 starting adjacent to the edges 24 of the well 19, e.g. at the line 25, then the liquefied mud mass will flow in the direction of the well 19 and be discharged by the pump. Now again one can operate stripwise in a manner such that always each path of liquefied mud by itself flows in the direction of the well 19. The pressure conduit 22 can discharge on a storage yard, in the hold of a hopper or at any other suitable place.

By means of FIG. 1 has been described how with the aid of the apparatus the mud first has been removed according to a path 14, thereafter next to the path 14 one or more subsequent parallel paths were treated and only thereafter the parts 16, 17 extending transversely to said areas, starting with the part lying closest to the mouth.

According to the invention it may be desirable, however, first to make a single path 14 so that a flow channel is formed and thereafter to start with the transverse path or transverse paths lying most remote from the mouth 13, so that the liquefied mud can flow towards the channel 14 and from it towards the river. The subsequent transverse paths then lie more close to the mouth.

If desired in the flow channel 14 a supporting flow can be generated. Upon application of the apparatus shown in FIGS. 2 to 4 inclusive one has to take care that the jets leaving the tube 9 do not disturb the original bottom.

If one applies the method as described by means of FIGS. 5 and 6 one has to take care that the capacity of the pump in the well is adapted to the supply of water injected mud to prevent that too much water is added to the mixture to be pumped. It is of importance to maintain a buffer quantity of mud inside the well.

I claim:

1. Method for removing mud deposited upon the bottom of a water area in which flow, if occurring, at least temporarily is slight or absent, such that solid particles present in the water are deposited in the form of a layer which in times of flow is substantially maintained, which mud layer is removed by making use of water jets, said method comprising liquidizing the mud layer by means of jet nozzles inserted directly into the mud layer only to an extent sufficient to make a thick liquified flowable pulp of the mud but insufficient to cause the mud to again mix with upper layers of the surrounding water, with the water leaving said nozzles is transferred into a thick liquefied condition that the mud substance liquefied in this way being capable of flowing under the influence of its difference in specific mass with respect to the water; flowing the liquidized mud towards a place at a level lower than the upper limit of the mud layer and preferably at the level of the original bottom or lower, at which place a mud carrying flow exits or is generated.

2. Method as claimed in claim 1, in particular for a habour basin bordering a flowing water, such as a river, further comprising starting the liquidizing at the mouth of the habour basin towards the river and proceeding according to a path directed away from the mouth so that each subsequent path, as far as space is available, also starts at the mouth adjacent to an already treated path.

3. Method as claimed in claim 2, in which, in a habour basin having at least one basin extending laterally next to the mouth or inlet, said basin is treated subsequently by means of at least one path made from the mouth and according to a path directed away from the previously made path and according to adjacent paths.

4. Method as claimed in claim 1 in particular for a habour basin joining a flowing water, such as a river, further comprising starting the liquidizing at the mouth and proceeding inwardly to form a layer channel and that after the completion of the channel the mud layer is treated at a location at a distance away from the mouth, always starting from the channel or the already treated area respectively, each subsequent path starting from the channel being more close to the mouth.

5. Method as claimed in claim 1, further comprising forming a recess or well in the bottom of the area to be treated and placing in said recess or well the suction mouth of a suction pressure pump and starting the liquidizing adjacent to the edge of the recess or well and proceeding in a direction away from said recess or well.

6. The method of claim 1 further comprising generating an artificial flow of water in the area to be treated so as to support the liquefied mud mass in its movement towards a discharge.

7. The method of claim 1 further comprising moving the liquefied mud mass with a pushing blade in a direction toward the discharge.

* * * * *